US011626239B2

(12) United States Patent
Okuda

(10) Patent No.: US 11,626,239 B2
(45) Date of Patent: Apr. 11, 2023

(54) WIRE-WOUND INDUCTOR

(71) Applicant: Murata Manufacturing Co., Ltd., Kyoto-fu (JP)

(72) Inventor: Koji Okuda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 480 days.

(21) Appl. No.: 16/777,808

(22) Filed: Jan. 30, 2020

(65) Prior Publication Data

US 2020/0265989 A1 Aug. 20, 2020

(30) Foreign Application Priority Data

Feb. 15, 2019 (JP) ..... JP2019-025628

(51) Int. Cl.
*H01F 27/28* (2006.01)
*H01F 27/29* (2006.01)
*H01F 27/24* (2006.01)

(52) U.S. Cl.
CPC ..... *H01F 27/2823* (2013.01); *H01F 27/24* (2013.01); *H01F 27/29* (2013.01)

(58) Field of Classification Search
CPC ..... H01F 27/2823; H01F 27/24; H01F 27/29
See application file for complete search history.

(56) References Cited

U.S. PATENT DOCUMENTS

2012/0119859 A1 5/2012 Nishino et al.
2015/0022309 A1* 1/2015 Marusawa ..... C08L 101/00 252/62.55
2018/0182528 A1* 6/2018 Miyamoto ..... H01F 5/04
2018/0322996 A1* 11/2018 Kobayashi ..... H01F 17/045
2019/0172623 A1* 6/2019 Ito ..... H01F 17/045
(Continued)

FOREIGN PATENT DOCUMENTS

JP 2005-191395 A 7/2005
JP 2009-158735 A 7/2009
JP 2012-109408 A 6/2012

OTHER PUBLICATIONS

An Office Action; "Decision of Refusal," mailed by the Japanese Patent Office dated Apr. 5, 2022, which corresponds to Japanese Patent Application No. 2019-025628 and is related to U.S. Appl. No. 16/777,808 with English language translation.
(Continued)

*Primary Examiner* — Michael P McFadden
(74) *Attorney, Agent, or Firm* — Studebaker & Brackett PC

(57) ABSTRACT

A wire-wound inductor includes a core that includes a columnar winding core portion having a side surface extending in an up-down direction, an upper flange disposed at an upper end of the winding core portion, and a lower flange disposed at a lower end of the winding core portion. The wire-wound inductor also includes a pair of terminal electrodes formed at the lower flange and a wire wound around the side surface of the winding core portion, the wire having both end portions coupled to respective terminal electrodes. In the wire-wound inductor, a ratio Sa/Sb of a cross-sectional area Sa to a lateral area Sb is one or more, where the cross-sectional area Sa is an area of cross section of the winding core portion and the lateral area Sb is an area of a side-surface extension portion that passes through the upper flange.

4 Claims, 8 Drawing Sheets

(56) References Cited

U.S. PATENT DOCUMENTS

| | | | | |
|---|---|---|---|---|
| 2020/0105451 | A1* | 4/2020 | Horie | H01F 17/045 |
| 2020/0227196 | A1* | 7/2020 | Ochiai | H01F 27/2823 |

OTHER PUBLICATIONS

An Office Action; "Notice of Reasons for Refusal," mailed by the Japanese Patent Office dated Oct. 5, 2021, which corresponds to Japanese Patent Application No. 2019-025628 and is related to U.S. Appl. No. 16/777,808 with English translation.

* cited by examiner

WIRE-WOUND INDUCTOR

CROSS-REFERENCE TO RELATED APPLICATION

This application claims benefit of priority to Japanese Patent Application No. 2019-025628, filed Feb. 15, 2019, the entire content of which is incorporated herein by reference.

BACKGROUND

Technical Field

The present disclosure relates to a wire-wound inductor.

Background Art

Various types of wire-wound inductors have been used in electronic devices. A type of wire-wound inductor includes a core having a winding core portion and flanges at both ends of the winding core portion and also includes a wire wound around the winding core portion. For example, a wire-wound inductor according to Japanese Unexamined Patent Application Publication No. 2005-191395 has terminal electrodes formed only at one of the flanges (a lower flange). Accordingly, the side surface of the winding core portion extends in the up-down direction (vertical direction) from a principal surface of the circuit substrate on which the wire-wound inductor is mounted. A magnetic field generated in the winding core portion by an electric current flowing in the wire is directed perpendicularly to the principal surface of the circuit substrate.

In general, a wire-wound inductor serving as an inductance element in an electric circuit is mainly characterized in terms of inductance and direct current resistance. In order to increase the inductance and reduce the direct current resistance on the basis of a given outside dimension, the wire is often wound around in multiple layers or a large-diameter wire is used. Accordingly, a major concern about a typical wire-wound inductor is how to reduce the diameter of the winding core portion, in other words, how to reduce the area of cross section of the winding core portion.

However, the present inventor has found that it is necessary to view this issue differently when the wire-wound inductor is used as a device that generates a magnetic field from the electric current flowing through the wire and emits the magnetic field from a flange. In the wire-wound inductor in which the side surface of the winding core portion extends in the up-down direction as described in Japanese Unexamined Patent Application Publication No. 2005-191395, the present inventor has focused on radiation efficiency of the magnetic field emitted from a flange (upper flange) of the inductor located opposite to the circuit substrate.

SUMMARY

Accordingly, the present disclosure provides a wire-wound inductor that improves radiation efficiency of a magnetic field emitted from an upper flange of the inductor.

A wire-wound inductor according to an aspect of the present disclosure includes a core that includes a columnar winding core portion having a side surface extending in an up-down direction, an upper flange disposed at an upper end of the winding core portion, and a lower flange disposed at a lower end of the winding core portion. The wire-wound inductor also includes a pair of terminal electrodes formed at the lower flange and a wire wound around the side surface of the winding core portion. The wire has both end portions coupled to respective terminal electrodes. In the wire-wound inductor, a ratio of a cross-sectional area Sa to a lateral area Sb, or Sa/Sb, is one or more, where the cross-sectional area Sa is an area of cross section of the winding core portion and the lateral area Sb is an area of a side-surface extension portion that is a section of the upper flange formed when the side surface of the winding core portion is virtually extended in the up-down direction and passes through the upper flange.

According to this configuration, a portion of the magnetic field emitted from the upper flange increases relative to the entire magnetic field generated by the current flowing through the wire, which can improve radiation efficiency of magnetic field.

According to an aspect of the present disclosure, a wire-wound inductor that improves radiation efficiency of a magnetic field emitted from an upper flange of the inductor can be provided.

Other features, elements, characteristics and advantages of the present disclosure will become more apparent from the following detailed description of preferred embodiments of the present disclosure with reference to the attached drawings.

DETAILED DESCRIPTION

Figure 1:
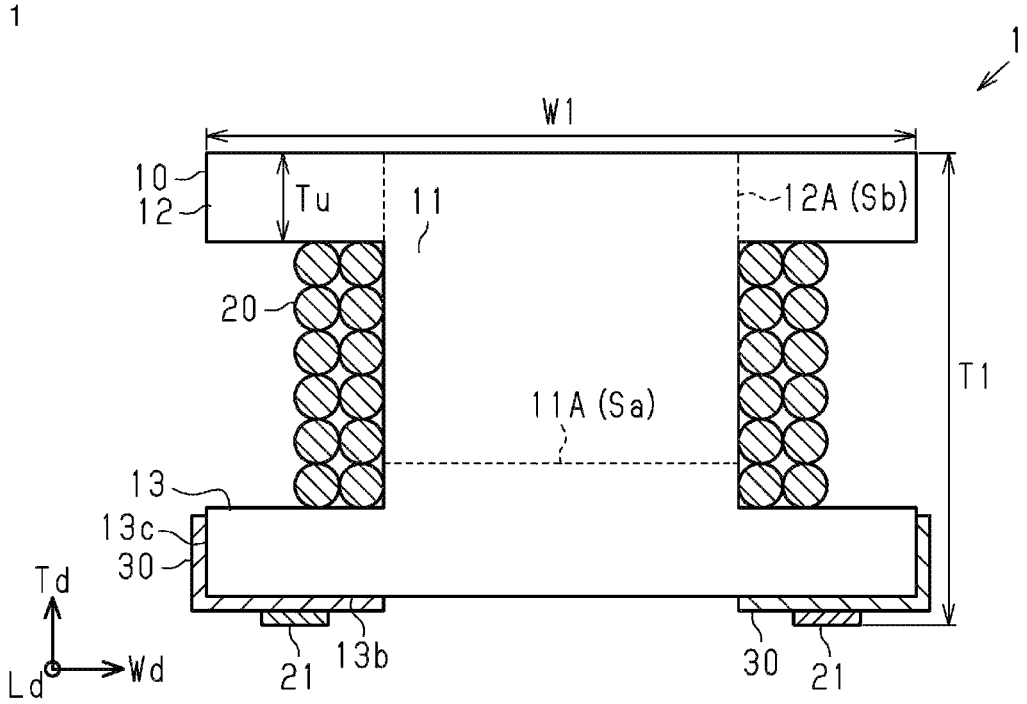
FIG. 1 is a schematic cross-sectional view illustrating a wire-wound inductor according to an embodiment.

An embodiment will be described with reference to the drawings.

Note that in the drawings, elements may be illustrated in an enlarged manner so as to facilitate better understanding. Dimensional relations of elements in the drawings may be different from the actual elements or different from each other. Some elements in cross-sectional views may be indicated by hatching so as to facilitate better understanding, but hatching may be omitted for other elements in some cases.

Figure 2:
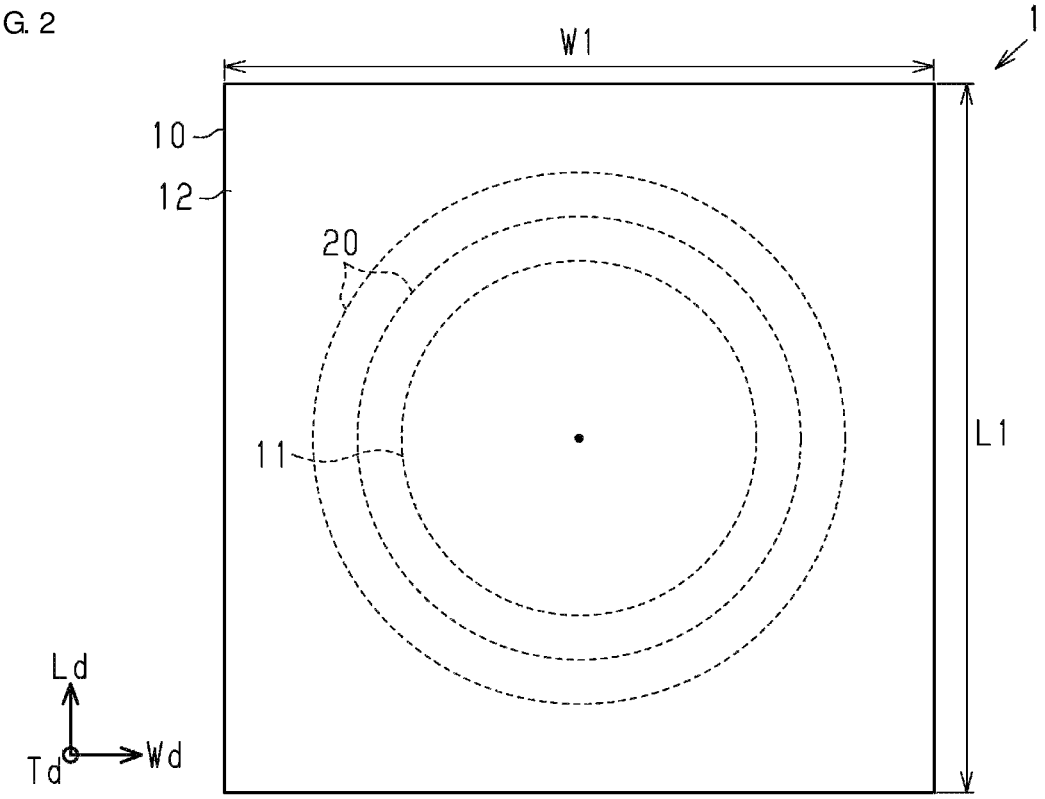
FIG. 2 is a schematic plan view illustrating the wire-wound inductor.
Figure 3:
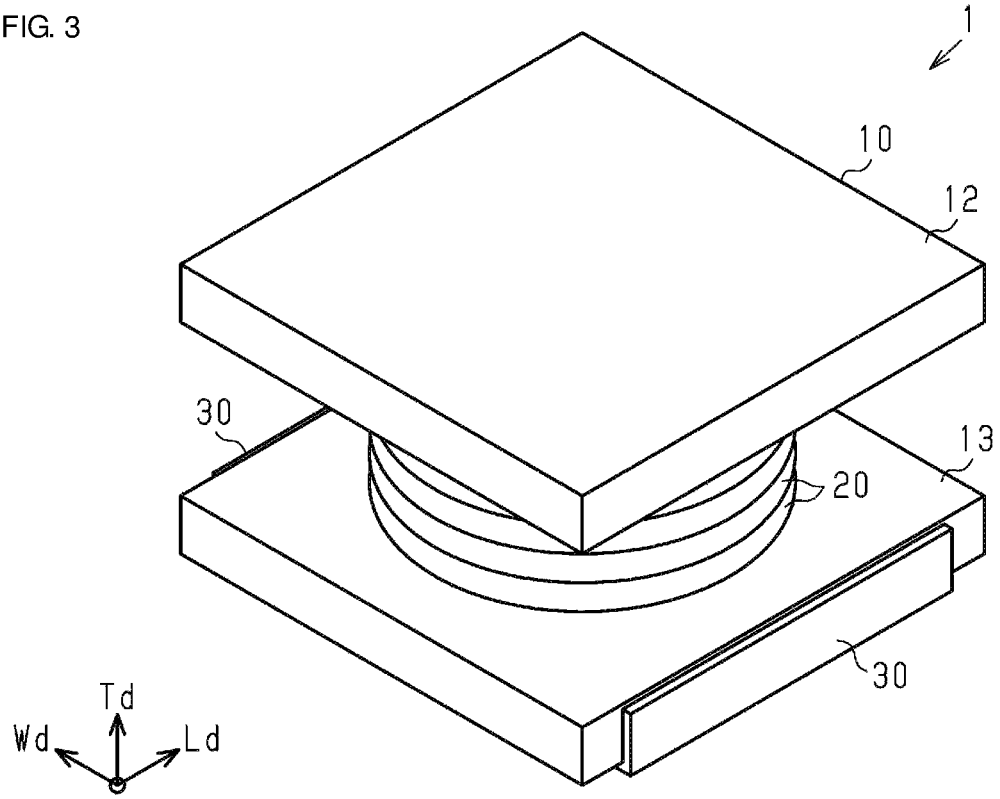
FIG. 3 is a schematic perspective view illustrating the wire-wound inductor.

A wire-wound inductor 1 illustrated in FIGS. 1 to 3 is, for example, a surface-mount type wire-wound inductor to be mounted on a circuit substrate. The circuit substrate may include a communication circuit for short-range wireless communication. In this case, the wire-wound inductor 1 is used as a transmitting and receiving antenna for short-range wireless communication. For example, the wire-wound inductor 1 is used as a transmitting and receiving antenna for near-field magnetic induction (NFMI) communication.

The wire-wound inductor 1 according to the present embodiment includes a core 10 that is constituted by a columnar winding core portion 11 having a side surface extending in the up-down direction, an upper flange 12 disposed at the upper end of the winding core portion 11, and a lower flange 13 disposed at the lower end of the winding core portion 11. The wire-wound inductor 1 also includes a pair of terminal electrodes 30 formed at the lower flange 13 and a wire 20 wound around the side surface of the winding core portion 11. Both end portions of the wire 20 are coupled to respective terminal electrodes 30. The winding core portion 11, the upper flange 12, and the lower flange 13 are integrally formed as one body, but these may be provided as separate components and combined into one body. Note that the above-described side surface of the winding core portion 11 refers to the entire circumferential surface of the winding core portion 11 around which the wire 20 is wound.

In the present specification, the up-down direction in which the winding core portion 11 extends as illustrated in FIGS. 1 to 4 is referred to as the "height direction Td". The right-left direction in FIGS. 1 and 2, which orthogonally intersects the height direction Td, is referred to as the "width direction Wd", and a direction that orthogonally intersects both the height direction Td and the width direction Wd is referred to as the "length direction Ld". As is apparent from FIGS. 1 and 2, the width direction Wd and the length direction Ld are designated only for convenience of description, and such designation is not essential. The width direction Wd and the length direction Ld may be designated interchangeably. In this case, the length direction Ld corresponds to the up-down direction in FIG. 2. Note that the up-down direction is defined with respect to a direction in which the winding core portion 11 extends, which may or may not correspond to the gravitational direction.

The size of the wire-wound inductor 1 in the length direction Ld (i.e., the length L1) is preferably 2.5 mm or more and 9 mm or less (i.e., from 2.5 mm to 9 mm). The length L1 of the wire-wound inductor 1 according to the present embodiment is, for example, 3 mm.

The size of the wire-wound inductor 1 in the width direction Wd (i.e., the width W1) is preferably 2.5 mm or more and 9 mm or less (i.e., from 2.5 mm to 9 mm). The width W1 of the wire-wound inductor 1 according to the present embodiment is, for example, 3 mm.

The size of the wire-wound inductor 1 in the height direction Td (i.e., the height T1) is preferably 2.5 mm or more and 9 mm or less (i.e., from 2.5 mm to 9 mm). The height T1 of the wire-wound inductor 1 according to the present embodiment is, for example, 3 mm.

Figure 4:
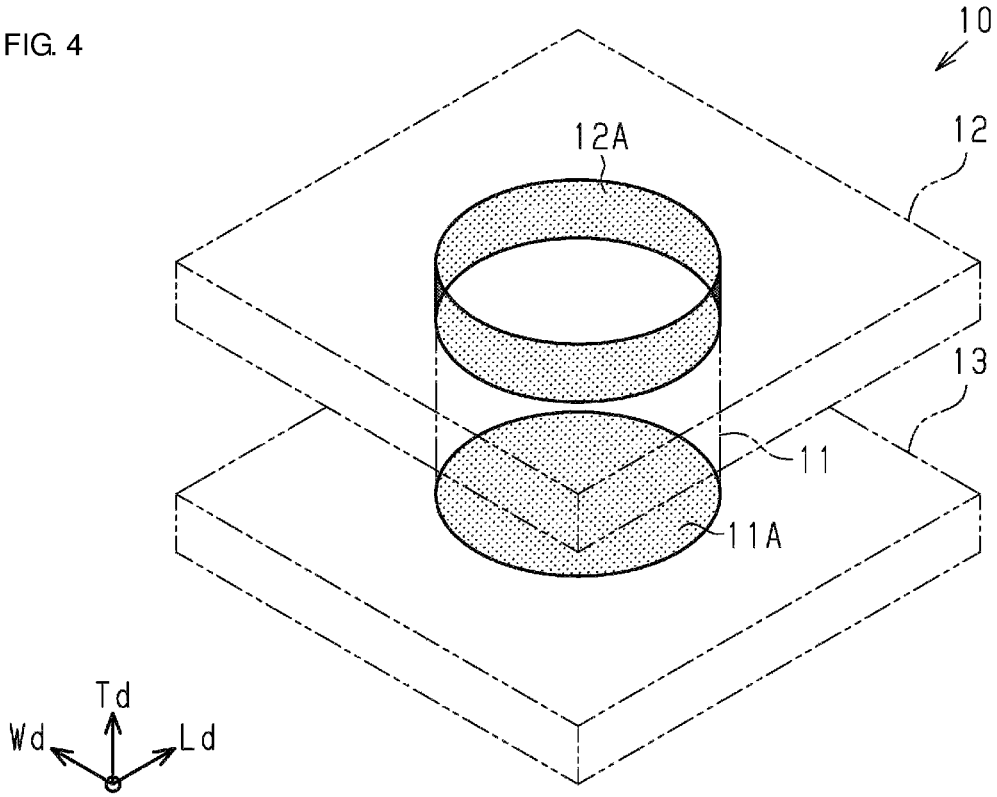
FIG. 4 is a schematic perspective view for explanation of a cross-section of a core.

As illustrated in FIG. 4, the winding core portion 11 is shaped like a circular column extending in the height direction Td. The upper flange 12 and the lower flange 13 are both shaped like plates each of which has quadrangular principal surfaces and has a thickness smaller in the height direction Td. For example, thicknesses Tu of the upper flange 12 and the lower flange 13 in the height direction Td are both 0.5 mm. In the present embodiment, as illustrated in FIG. 2, the principal surfaces of the upper flange 12 and the lower flange 13 are shaped like squares with each length L1 being substantially equal to each width W1.

The winding core portion 11 according to the present embodiment has a circular cross section when cut in a direction orthogonally intersecting the height direction Td. Note that the shape of the winding core portion 11 may be changed appropriately. For example, the winding core portion 11 may be shaped like a column having a cross section of a polygon such as a quadrangle, a circle, an ellipse, or a combination of these.

The material of the core 10 may be a magnetic material (for example, nickel-zinc (Ni—Zn) based ferrite or manganese-zinc (Mn—Zn) based ferrite), an alumina, or a magnetic metal. The core 10 can be obtained, for example, by molding and sintering powder of such a material. The core 10 may be a resin compact containing powder of a magnetic substance.

The terminal electrodes 30 are formed at two positions on the surface of lower flange 13 of the core 10. One of end portions 21 of the wire 20 is coupled to one of the terminal electrodes 30, and the other one of the end portions 21 is coupled to the other one of the terminal electrodes 30. Accordingly, the input/output terminals of the wire 20 are disposed at the lower flange 13, and the wire 20 forms a vertical helical structure having the winding axis extending perpendicular to the principal surface of the circuit substrate. This enables the number of windings of the wire 20 to increase easily. Each terminal electrode 30 has an L-shaped electrode structure in which an electrode on a lower surface 13*b* of the lower flange 13 is joined to an electrode on a side surface 13*c* of the lower flange 13 located at an end in the width direction Wd. Two electrodes are integrally joined at the ridge line between the lower surface 13*b* and the side surface 13*c*. Note that the terminal electrodes 30 may be disposed at least at the lower surface 13*b* of the lower flange 13, in other words, the terminal electrodes 30 may be formed into a bottom electrode structure.

The terminal electrodes 30 are made of electroconductive material. For example, each terminal electrode 30 has a metallic layer made of a single metal, such as copper (Cu), silver (Ag), chromium (Cr), or titan (Ti), or made of an alloy containing metals listed here. A plating layer may be formed on the metallic layer. The plating layer may be made of a metal, such as nickel (Ni), Cu, μg, or tin (Sn), or made of an alloy containing metals listed here. Note that the plating layer may be formed as a structure including a plurality of metallic layers (plating layers).

The wire 20 is a thread-like conductor made of, for example, Cu, and having an insulating coating, such as a resin, that covers the surface of the conductor. The wire 20 are wound around the side surface of the winding core portion 11 of the core 10. Both end portions 21 of the wire 20 are connected to respective terminal electrodes 30 by, for example, plating, soldering, thermocompression bonding, or welding. The thickness (diameter) of the wire 20 is, for example, 0.1 mm.

Note that the wire 20 may be covered by a covering resin disposed between the upper flange 12 and the lower flange 13 of the core 10 except for lead portions extending to the terminal electrodes 30. The material of the covering resin is, for example, a thermosetting resin such as an epoxy-based resin. The covering resin may include a magnetic powder or a non-magnetic powder such as a silica filler.

Referring to FIG. 4, a cross-sectional area Sa denotes the area of the cross section 11A of the winding core portion 11 that orthogonally intersects the height direction Td. A side-surface extension portion is defined in the up-down direction when the side surface of the winding core portion is virtually extended in the up-down direction. In addition, a lateral area Sb denotes the area of a side-surface extension portion 12A that passes through the upper flange 12. In this case, the ratio of the cross-sectional area Sa to the lateral area Sb, in other words, Sa/Sb, is one or more.

In the case of the winding core portion 11 being shaped like a circular column, the cross-sectional area Sa can be calculated from the outside diameter of the winding core portion 11. The lateral area Sb can be calculated from the circumference of the winding core portion 11 at the cross section 11A and the thickness Tu of the upper flange 12. In the case in which the shape of the cross section 11A changes at positions in the height direction Td, the cross-sectional area Sa and the lateral area Sb are calculated on the basis of a cross section 11A at a position at which the winding core portion 11 is in contact with the upper flange 12.

Note that the cross-sectional area Sa of the winding core portion 11 is preferably configured such that when the wire 20 is wound around the side surface of the winding core portion 11, the wound wire 20 does not project beyond the peripheral edge of the upper flange 12. According to this configuration, the wire 20 does not project beyond the peripheral edge of the upper flange 12, which suppresses the increase of the outside dimension of the wire-wound inductor 1 (in other words, the outside dimension of the core 10) and also reduces the likelihood of the wire 20 being broken or short-circuited.

In general, a major concern related to the wire-wound inductor 1, as described before, is how to reduce the size of the cross section 11A of the winding core portion 11. However, the present inventor has found that it is necessary to view this issue differently when the wire-wound inductor 1 is used as a device that generates a magnetic field from the electric current flowing through the wire 20 and emits the magnetic field from the upper flange 12, which is further described below.

For example, when the direction of the current flowing through the wire 20 is set appropriately, the electric current flowing through the wire 20 wound around the side surface of the winding core portion 11 generates a magnetic field that is directed toward the upper flange 12 in the winding core portion 11. Here, the cross-sectional area Sa of cross section 11A of the winding core portion 11 is the area through which the magnetic field passes. Next, the magnetic field entering the upper flange 12 from the winding core portion 11 spreads out in the upper flange 12 in in-plane directions of the principal surface thereof that orthogonally intersects the height direction Td. Here, the lateral area Sb of side-surface extension portion 12A of the upper flange 12 is the area through which the magnetic field passes.

If the lateral area Sb is made smaller than the cross-sectional area Sa of the winding core portion 11, in other words, if Sa/Sb is made larger than one, the magnetic field generated in the winding core portion 11 is readily emitted from the upper surface of upper flange 12 of the wire-wound inductor 1 (core 10) without spreading out in in-plane directions of the principal surface of the upper flange 12. Thus, the wire-wound inductor 1 according to the present embodiment increases the portion of the magnetic field emitted from the upper flange 12 relative to the entire magnetic field generated by the current flowing through the wire 20, which improves radiation efficiency of magnetic field.

Figure 5A:
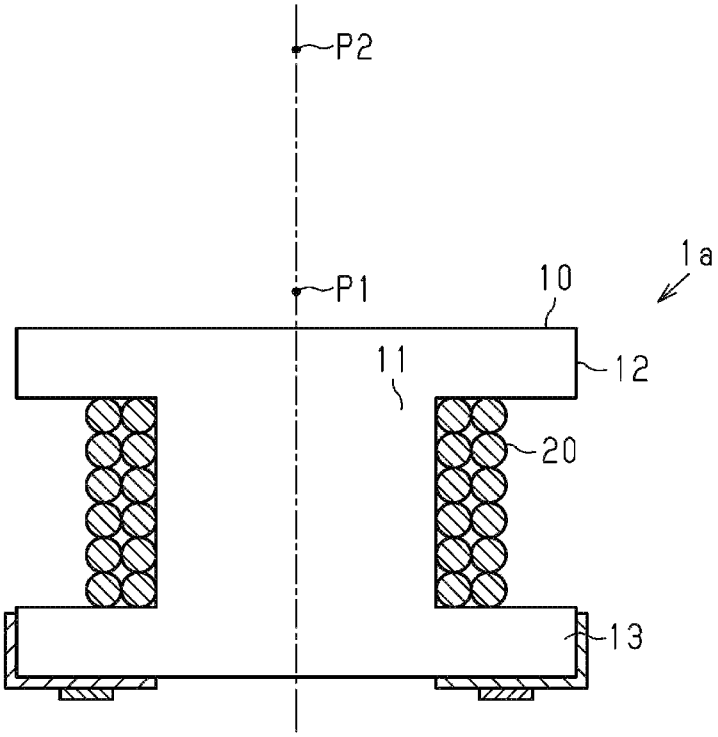
FIG. 5A and FIG. 5B are schematic cross-sectional views illustrating wire-wound inductors for explaining the shape of the core.
Figure 5B:
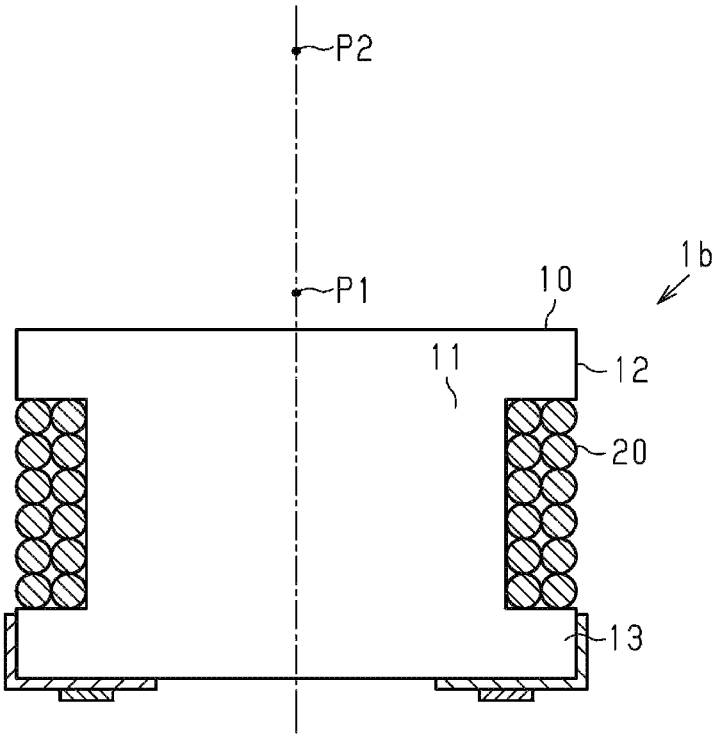

The present inventor developed models of the wire-wound inductor 1 for simulations and studied magnetic-field radiation characteristics by performing electromagnetic field analysis using the finite element method. FIG. 5A illustrates a first model. The first model is a wire-wound inductor 1*a* in which the ratio of the cross-sectional area Sa to the lateral area Sb, or Sa/Sb, is set at one. FIG. 5B illustrates a second model. The second model is a wire-wound inductor 1*b* in which the cross-sectional area Sa is set at a maximum value while the wire 20 is side of the peripheral edge of the upper flange 12 when the wire 20 is wound around the side surface of the winding core portion 11. As illustrated in FIGS. 5A and 5B, the ratio of magnetic field strength between point P1 and point P2, which are points predetermined distances away from the upper flange 12, was calculated for each of the wire-wound inductors 1*a* and 1*b*. In the present embodiment, point P1 is located 1 mm away from the upper flange 12, and point P2 is located 100 mm away from the upper flange 12. Ratios of magnetic field strength between point P1 and point P2 were obtained as relative values (dB) for each of the wire-wound inductors 1*a* and 1*b* for which the length L1 and the width W1 (outside dimension) of the upper flange 12 were both set at 2.5 mm, 3 mm, 5 mm, 7 mm, and 9 mm.

Figure 6:
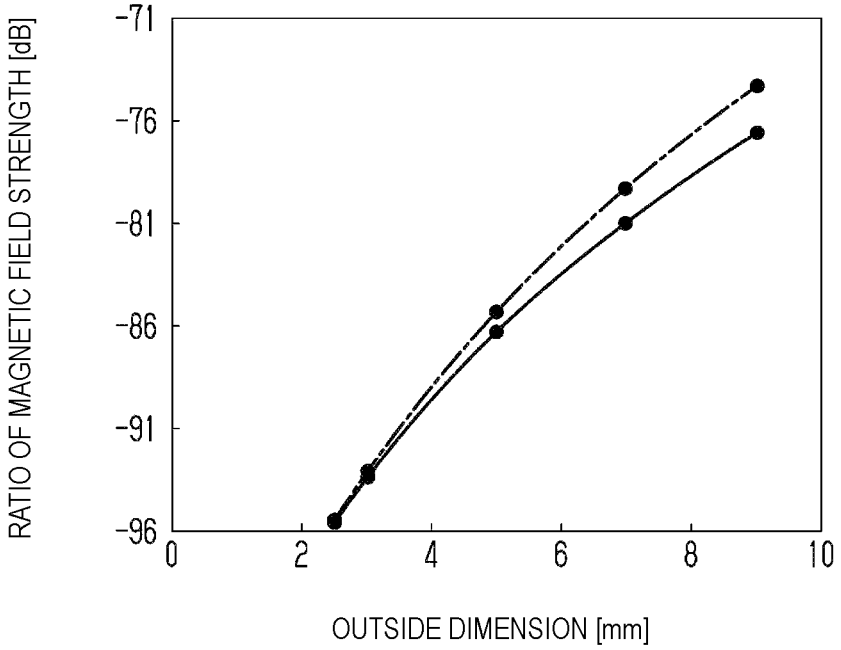
FIG. 6 is a diagram illustrating a ratio of magnetic field strength with respect to outside dimension.

FIG. 6 illustrates the ratios of magnetic field strength of the wire-wound inductors with respect to the outside dimensions thereof. In FIG. 6, the solid line indicates characteristics of a wire-wound inductor 1 of FIG. 5A, and the dash-dot line indicates characteristics of a wire-wound inductor 1 of FIG. 5B. The results in FIG. 6 shows that in the wire-wound inductors 1*a* and 1*b* of which the upper flanges 12 have the same outside dimension, the magnetic-field radiation characteristics can be improved, more specifically, the attenuation of the magnetic field with respect to the distance can be reduced, as the cross-sectional area Sa of the winding core portion 11 increases. In addition, according to FIG. 6, the larger the outside dimension of the upper flange 12 becomes, the less the attenuation of the magnetic field can be with respect to the distance.

Next, the present inventor studied magnetic-coupling characteristics between two wire-wound inductors 1 by performing simulation. The above-described first and second models were also used in this study, in other words, the wire-wound inductor 1*a* of FIG. 5A and the wire-wound inductor 1*b* of FIG. 5B were used. Coupling coefficients between two wire-wound inductors 1*a* and coupling coefficients between two wire-wound inductors 1*b* were calculated by performing the electromagnetic field analysis.

Figure 7:
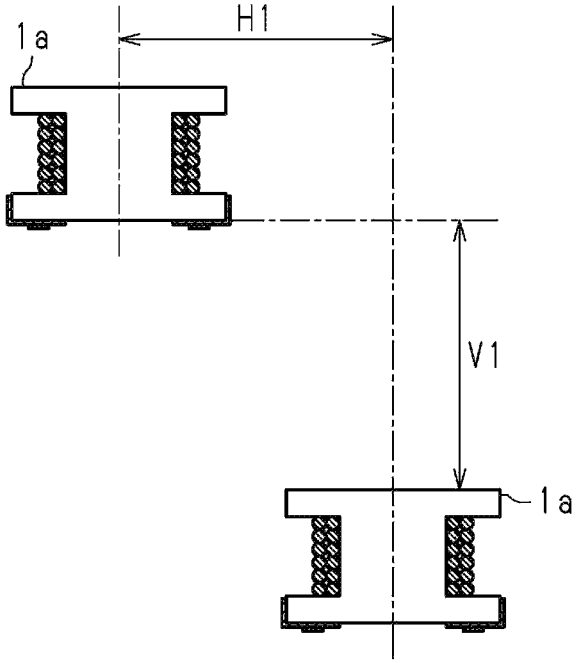
FIG. 7 is a schematic view for explanation of coupling-coefficient measurement between wire-wound inductors.

In this study, as illustrated in FIG. 7, two wire-wound inductors 1*a* (or 1*b*) were placed so as to have a predetermined distance V1 between each other in the extending direction of the winding core portions 11 (in the up-down direction in FIG. 7) while respective winding core portions 11 were kept so as to extend parallel to each other. One of the wire-wound inductors 1*a* was shifted with respect to the other wire-wound inductor 1*a* in a direction orthogonally intersecting the extending direction of the winding core portions 11 (i.e., in the right-left direction in FIG. 7). The coupling coefficient between the two wire-wound inductors 1*a* was calculated with respect to the shifted distance (horizontal distance) HE Note that the predetermined distance V1 was set at 10 mm in the simulation.

FIGS. 8 to 12 illustrate characteristics of the coupling coefficient with respect to the horizontal distance H1, which were obtained from the simulation for the wire-wound inductors 1*a* and 1*b* in which the length L1 and the width W1 (outside dimension) of the corresponding upper flange 12 were changed. In FIGS. 8 to 12, the horizontal axis represents the horizontal distance (mm), and the vertical axis represents the coupling coefficient (note that the value is in the order of 10 to the sixth power). In addition, in FIGS. 8 to 12, the solid line indicates the characteristics of the wire-wound inductors 1*a* of FIG. 5A, and the dash-dot line indicates the characteristics of the wire-wound inductors 1*b* of FIG. 5B.

Figure 8:
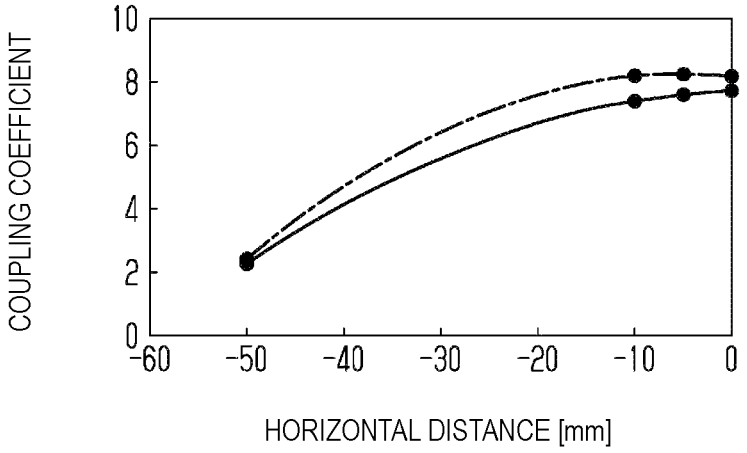
FIG. 8 is a diagram illustrating coupling coefficient with respect to horizontal distance.
Figure 9:
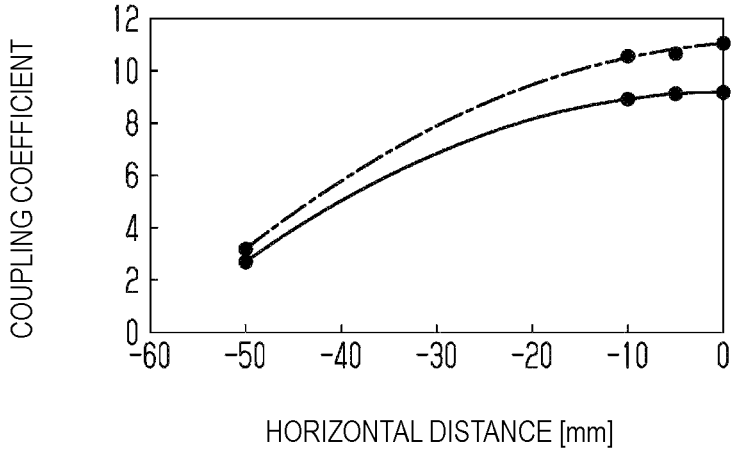
FIG. 9 is a diagram illustrating coupling coefficient with respect to horizontal distance.
Figure 10:
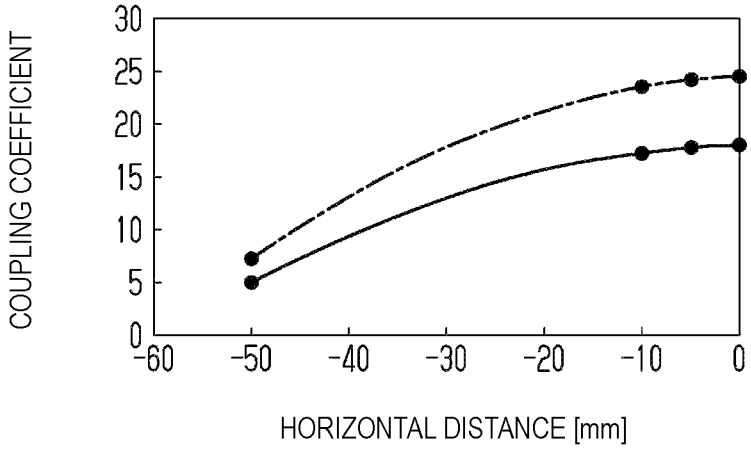
FIG. 10 is a diagram illustrating coupling coefficient with respect to horizontal distance.
Figure 11:
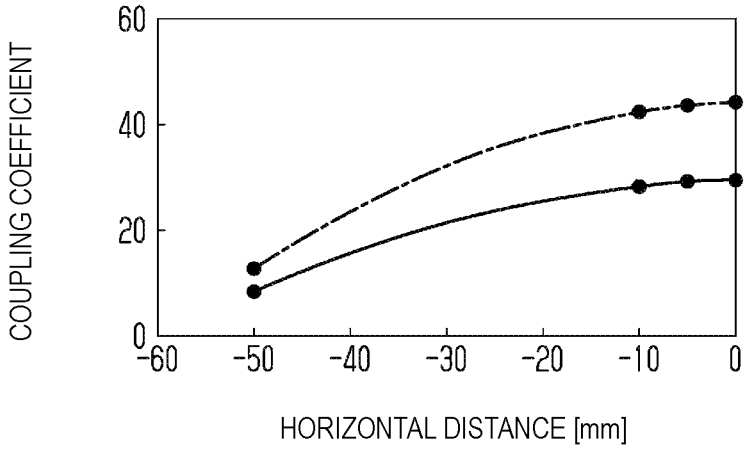
FIG. 11 is a diagram illustrating coupling coefficient with respect to horizontal distance.
Figure 12:
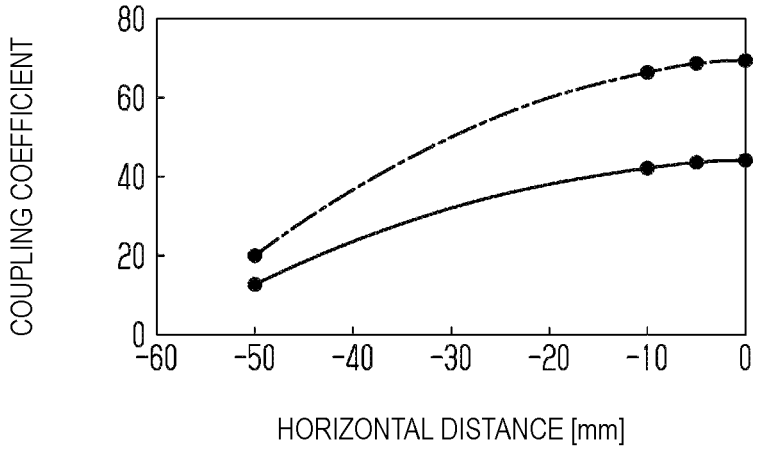
FIG. 12 is a diagram illustrating coupling coefficient with respect to horizontal distance.

FIG. 8 shows calculation results of coupling coefficient with respect to the horizontal distance H1 for the wire-wound inductors 1*a* and 1*b* having the cores 10 in which the lengths L1 and the widths W1 of the corresponding upper flanges 12 are both set at 2.5 mm FIG. 9 shows calculation results of coupling coefficient with respect to the horizontal distance H1 for the wire-wound inductors 1*a* and 1*b* having the cores 10 in which the lengths L1 and the widths W1 of the corresponding upper flanges 12 are both set at 3 mm FIG. 10 shows calculation results of coupling coefficient with respect to the horizontal distance H1 for the wire-wound inductors 1*a* and 1*b* having the cores 10 in which the lengths L1 and the widths W1 of the corresponding upper flanges 12 are both set at 5 mm FIG. 11 shows calculation results of coupling coefficient with respect to the horizontal distance H1 for the wire-wound inductors 1*a* and 1*b* having the cores 10 in which the lengths L1 and the widths W1 of the corresponding upper flanges 12 are both set at 7 mm FIG. 12 shows calculation results of coupling coefficient with respect to the horizontal distance H1 for the wire-wound inductors 1*a* and 1*b* having the cores 10 in which the lengths L1 and the widths W1 of the corresponding upper flanges 12 are both set at 9 mm.

According to FIGS. 8 to 12, in the case of the cores having the same outside dimension (the same length L1 and the same width W1), the coupling coefficient between two wire-wound inductors 1*a* (or 1*b*) can be improved as the cross-sectional area Sa of the winding core portion 11 becomes larger. Similarly, according to FIGS. 8 to 12, in the case in which Sa/Sb is the same, the coupling coefficient can be improved as the outside dimension becomes larger.

Note that in the wire-wound inductor 1 according to the present embodiment, the lateral area Sb is preferably 3.3 $mm^2$ or more and 13.8 $mm^2$ or less (i.e., from 3.3 $mm^2$ to 13.8 $mm^2$). It has been confirmed that in this range, the magnetic field generated in the winding core portion 11 is emitted efficiently from the upper flange 12 of the wire-wound inductor 1 and the wire-wound inductor 1 exhibits favorable magnetic-field radiation characteristics and favorable coupling efficiency.

In addition, in the wire-wound inductor 1, the cross-sectional area Sa is preferably 3.6 $mm^2$ or more and 60.8 $mm^2$ or less (i.e., from 3.6 $mm^2$ to 60.8 $mm^2$). It has been confirmed that in this range, the magnetic field generated in the winding core portion 11 is emitted efficiently from the upper flange 12 of the wire-wound inductor 1 and the wire-wound inductor 1 exhibits favorable magnetic-field radiation characteristics and favorable coupling efficiency.

As described above, the following advantageous effects can be obtained with the wire-wound inductor 1 according to the present embodiment.

1) The wire-wound inductor 1 includes the core 10 that has the columnar winding core portion 11 with the side surface extending in the up-down direction, the upper flange 12 disposed at the upper end of the winding core portion 11, and the lower flange 13 disposed at the lower end of the winding core portion 11. The wire-wound inductor 1 also includes a pair of the terminal electrodes 30 formed at the lower flange 13 and the wire 20 wound around the side surface of the winding core portion 11. Both end portions of the wire 20 are coupled to respective terminal electrodes 30. The cross-sectional area Sa denotes the area of the cross section 11A of the winding core portion 11, and a side-surface extension portion 12A is defined in the up-down direction when the side surface of the winding core portion 11 is virtually extended in the up-down direction, the lateral area Sb denotes the area of the side-surface extension portion 12A that passes through the upper flange 12. In this case, the ratio of the cross-sectional area Sa to the lateral area Sb, or Sa/Sb, is one or more. According to this configuration, the portion of the magnetic field emitted from the upper flange 12 increases relative to the entire magnetic field generated by the current flowing through the wire 20, which can improve radiation efficiency of magnetic field.

2) The wire 20 is wound around the side surface of the winding core portion 11 and is side of a peripheral edge of the upper flange 12. According to this configuration, the wire 20 is side of the peripheral edge of the upper flange 12, which suppresses the increase of outside dimension of the wire-wound inductor 1 and reduces the likelihood of the wire 20 being broken or short-circuited.

3) The lateral area Sb is preferably 3.3 $mm^2$ or more and 13.8 $mm^2$ or less (i.e., from 3.3 $mm^2$ to 13.8 $mm^2$). According to this configuration, the magnetic field generated in the winding core portion 11 is emitted efficiently from the wire-wound inductor 1, and the wire-wound inductor 1 exhibits favorable magnetic-field radiation characteristics and favorable coupling efficiency.

4) The cross-sectional area Sa is preferably 3.6 $mm^2$ or more and 60.8 $mm^2$ or less (i.e., from 3.6 $mm^2$ to 60.8 $mm^2$). According to this configuration, the magnetic field generated in the winding core portion 11 is emitted efficiently from the wire-wound inductor 1, and the wire-wound inductor 1 exhibits favorable magnetic-field radiation characteristics and favorable coupling efficiency.

Note that the above-described embodiment may be modified in the following manner.

The shape of the core of the above embodiment may be changed appropriately. Specifically, the shape of the lower flange 13 is not limited from the viewpoint of the radiation efficiency of magnetic field. Accordingly, the shape of the lower flange 13 may be modified independently of the upper flange 12.

Figure 13:
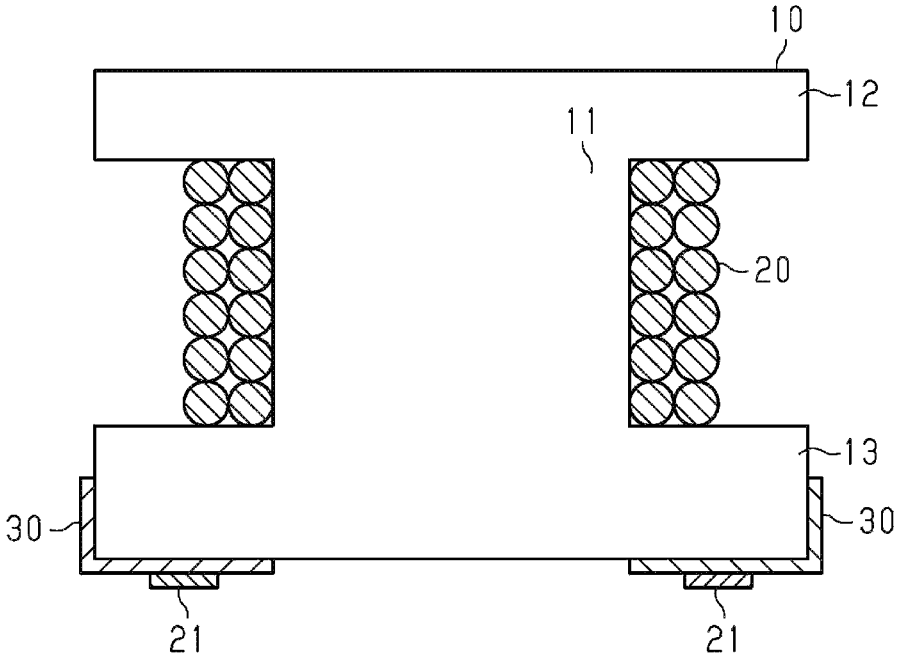
FIG. 13 is a schematic cross-sectional view illustrating a wire-wound inductor according to a modification example.

For example, as illustrated in FIG. 13, the core 10 may have the lower flange 13 that is thicker than the upper flange 12.

Figure 14:
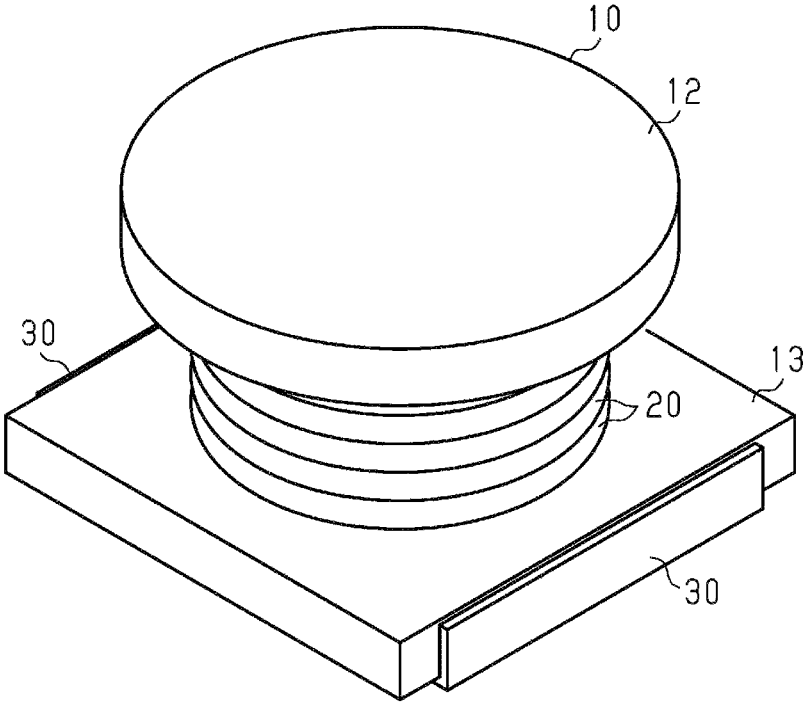
FIG. 14 is a schematic cross-sectional view illustrating a wire-wound inductor according to another modification example.

Alternatively, as illustrated in FIG. 14, the upper flange 12 may be shaped like a plate having circular principal surfaces. Note that in addition to the circular shape, the shape of principal surfaces of the upper flange 12 may be an oval, a polygon, or a combination thereof. Note that this also applies to the principal surfaces of the lower flange 13 although illustration is omitted. The shape of the lower flange 13 may or may not be the same as the shape of the upper flange 12.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wire-wound inductor comprising:

a core including a columnar winding core portion having a side surface extending in an up-down direction, an upper flange disposed at an upper end of the winding core portion, and a lower flange disposed at a lower end of the winding core portion;

a pair of terminal electrodes formed at the lower flange; and a wire wound around the side surface of the winding core portion, the wire having both end portions coupled to respective terminal electrodes, wherein a ratio Sa/Sb of a cross-sectional area Sa to a lateral area Sb is one or more, where the cross-sectional area Sa is an area of cross section of the winding core portion, a side-surface extension portion is defined in the up-down direction when the side surface of the winding core portion is virtually extended in the up-down direction, and the lateral area Sb is an area of the side-surface extension portion that passes through the upper flange, wherein the lateral area Sb is from 3.3 $mm^2$ to 13.8 $mm^2$.

2. The wire-wound inductor according to claim 1, wherein the wire is wound around the side surface of the winding core portion and is side of a peripheral edge of the upper flange.

3. The wire-wound inductor according to claim 2, wherein the cross-sectional area Sa is from 3.6 $mm^2$ to 60.8 $mm^2$.

4. The wire-wound inductor according to claim 1, wherein the cross-sectional area Sa is from 3.6 $mm^2$ to 60.8 $mm^2$.

* * * * *